United States Patent [19]

Weir

[11] Patent Number: 4,848,763

[45] Date of Patent: Jul. 18, 1989

[54] STACKING MACHINE FOR FABRIC ARTICLES

[76] Inventor: Henry J. Weir, "The Willow", Woodcroft Close,, Woodcroft, Chepstow, Gwent, Great Britain

[21] Appl. No.: 927,157

[22] Filed: Nov. 5, 1986

Related U.S. Application Data

[63] Continuation-in-part of Ser. No. 845,123, Mar. 27, 1986, abandoned.

[51] Int. Cl.[4] ..... B65H 29/08

[52] U.S. Cl. ..... 271/85; 271/195; 271/268

[58] Field of Search ..... 271/268, 85, 195

[56] References Cited

U.S. PATENT DOCUMENTS 3,376,036 4/1968 Weir ..... 271/85 X
3,704,884 12/1972 Nicolay ..... 271/85
4,511,130 4/1985 Barton ..... 271/85 X
4,512,563 4/1985 Bubley ..... 271/85

*Primary Examiner*—Richard A. Schacher
*Attorney, Agent, or Firm*—Russell E. Hattis; Daniel N. Christus

[57] ABSTRACT

A stacking machine includes a pair of gripping jaws that are openable and closable to grip a leading edge of an article and move it to a stacking position. The jaws are moved between a gripping position and a release position by a fluid cylinder assembly and are automatically moved to an intermediate position when the jaws are moved to receive an article. Air flow is used to straighten the trailing part of the article on the stack. The gripping jaws are moved between an article receiving position and an article discharge position by a pneumatic cylinder assembly that will accommodate variations in stack height.

20 Claims, 7 Drawing Sheets

20
22
23
24
25
26
28
30
32
36
40
A
P

P
36
28
26
22
30
20
40
A
29

STACKING MACHINE FOR FABRIC ARTICLES

REFERENCE TO RELATED APPLICATION

This application is a continuation-in-part application of U.S. Ser. No. 845,123, filed Mar. 27, 1986 now abandoned.

1. Technical Field

The invention relates to equipment for stacking fabric articles and is particularly useful in the stacking of articles of laundry after they have been processed through an ironing machine and/or a folding machine, for example.

2. Background Prior Art

The desirable requirements for a stacking system which is arranged to be part of a conveying process run or which is located at the end of a conveyor process run is to collect, stack, count and discharge the bundles of processed work to a central receiving position.

The equipment should be such that its stacking function can be easily bypassed, whereby certain articles which do not require stacking can be readily conveyed through the system. (This is important when articles which are too large to stack are handled through the same process line).

An important consideration is that the design of the stacking equipment is such that separate stacking units can be very closely banked together to handle the multi-lane work flow of articles which pass through the laundry ironing process. Also, it is desirable for the stacked and completed bundles to be delivered onto a discharge conveyor system whereby these bundles are directed to a single receiving station or can be onwardly conveyed to an automatic wrapping or packaging process. Existing and known methods of stacking which are employed at present have certain limitations and do not provide the total degree of versatility which is needed.

Many of the in-line multi-lane stacking machines which are located at the end of the processing runs block these runs from further onward conveying and prevent the discharge of articles which do not require stacking. These machines do not always permit the processed bundles to be directed to a single receiving station and may occupy considerable floor space.

Also, in present stacking machines it is common to provide complex stack-receiving decks which have to be automatically lowered as the stack grows in height and then have to be raised after each stack is discharged.

The most common type of existing stacking mechanism that is what is known as a wicket mechanism, which is pivoted at the end of a conveyor path. Such mechanism is disclosed in U.S. Pat. No. 3,684,274, and has the above-mentioned drawbacks of requiring considerable floor space and vertical clearance at the end of the conveyor and blocking effective bypass operations to a further conveyor.

Another example of laundry stacking apparatus is disclosed in British Pat. No. 1,255,741, which has the same shortcomings.

The physical design of most known stacking mechanisms does not enable them to be closely banked together. Therefore, on multi-lane operations, limitations are placed on the maximum width of articles which can be handled to a width which can be very much less than the processed width of the conveyor lanes. Some of the mechanisms are not capable of operating at a fast enough cycling speed for modern process rates and some mechanisms are limited to handle only specific sizes of articles.

The present invention seeks to provide a stacking arrangement which alleviates or overcomes at least some of these disadvantages.

SUMMARY OF THE INVENTION

According to one of the features of the present invention, a stacking machine is designed to be located in a confined space to receive articles from a first infeeding conveyor and position them in a stack on a fixed plane below the conveyor. To this end, the stacking machine includes a carrier frame upon which a pair of gripping jaws are mounted. The carrier frame is mounted for movement between an upper article-receiving position where the jaws are open to receive the leading edge of the article involved, and then closed to clamp the article therebetween, a lower article-released position where the leading edge of the article is deposited in a stacking plane defined by a support surface which could be a discharge conveyor. The carrier frame has a path of movement which is substantially more vertical than it is horizontal, so that the article does not have to be pulled outward from the end of the infeeding conveyor by the length of the article as in some prior art stacking devices. A force-applying means, most advantageously a means for directing high velocity air streams, are provided to push the trailing part of the article rearwardly down upon the support surface when the carrier means is moved to its lower position, so that articles of a wide variety of lengths are stacked at points directly vertically below the discharge end of the infeeding conveyor. Thus, this unique stacking machine does not require as large a floor area space or vertical extent as do the prior art stacking systems. Also, the moving parts of the stacking machines are relatively small and the path of movement thereof does not vary with the length of the material being stacked, so that increased stacking rates can readily be achieved especially for large articles.

In accordance with another aspect of the invention, the weight of the entire carrier frame and the jaws supported thereby is counterbalanced by spring means. The spring means reduces the force necessary to move the carrier frame and provides for a safer unit. Also, the driving means which moves the carrier frame between upper and lower positions can be a low pressure operated pneumatic cylinder, so that when the gripping jaws of the carrier frame place the leading edge of an article upon the top of the stack involved, the movement of the piston in the pneumatic cylinder is readily stopped by the opposition force created by the stack of articles, so that the stacking plane at the top of the stack progressively rises as the number of articles in the stack is increased. This makes unnecessary the requirement in prior art stacking devices of progressively lowering the bottom of the stack as the height of the stack is increased.

A further feature of the invention is the manner in which the direction of the high velocity air streams are automatically varied to its ideal orientations as the carrier frame is lowered. Thus, initially it is desirable that air streams are directed in a substantial horizontal direction as the carrier frame starts moving downwardly to pull the leading edge of the article upon the stacking plane. As the carrier frame lowers, it is desirable that the angle of the air stream be directed more in an inclined direction toward the stacking plane. It is also desirable to direct the air stream against the trailing part of the article at a point closest to that article where the air streams are effective. To this end, the most preferred form of the present invention mounts a horizontally extending air jet tube upon the carrier frame. When the carrier frame is its upper position, the stream is directed horizontally against the trailing part of the article at the appropriate time when the carrier frame starts moving downward. The carrier frame is preferably a pivoted frame so that as the carrier frame pivots downwardly it automatically varies the angle of the directed air streams in a downward and rearwardly inclining direction.

In accordance with a further feature of the invention, because of the unique mode of operation of the carrier frame and the gripping jaws carried thereby as described, a bypass conveyor can be located at reasonably low elevations in a plane slightly above the plane of the infeeding conveyor. The infeeding conveyor preferably comprises a series of spaced moving ribbons where bypass fingers can be conveniently located between these ribbons. The fingers are in a lowered position below the ribbons when stacking is desired. When these fingers are raised, they divert the path of movement of the articles onto the bypass conveyor when the stacking of the articles is not desired.

The unique stacking apparatus of the invention has a further advantage over the prior art. Unlike the stacking machines of the prior art, the unique design of the present invention does not require stationary side frames supporting bearings which support rotation of a wicket frame or the like which must move above and below the frame and for all practical purposes be located between the bearing-supporting side frames. In the present invention, identical stacking stations can be placed in close side-by-side relationship which is not practically possible with these prior art side frame constructions. For example, the in the case where the clamping jaws on the carrier frame comprise horizontally elongated jaw-forming bars, one of the bars is mounted for pivotal movement one side frames located between the ends thereof so that the ends of these bars for adjacent stations can be placed in close proximity. In the case where four identical stacking stations incorporating the features of the present invention are provided, each of the stations can be used separately for stacking narrow articles. For wider articles, a pair of adjacent stacking stations can be gauged for operation together so that they are used to stack wider articles.

The above and other features of the invention will become apparent upon making reference to the drawings and specification to follow.

BRIEF DESCRIPTION OF SEVERAL VIEWS OF DRAWINGS

The invention will further be described with reference to the accompanying drawings, of which:

DETAILED DESCRIPTION

Figures 1, 2, 3:
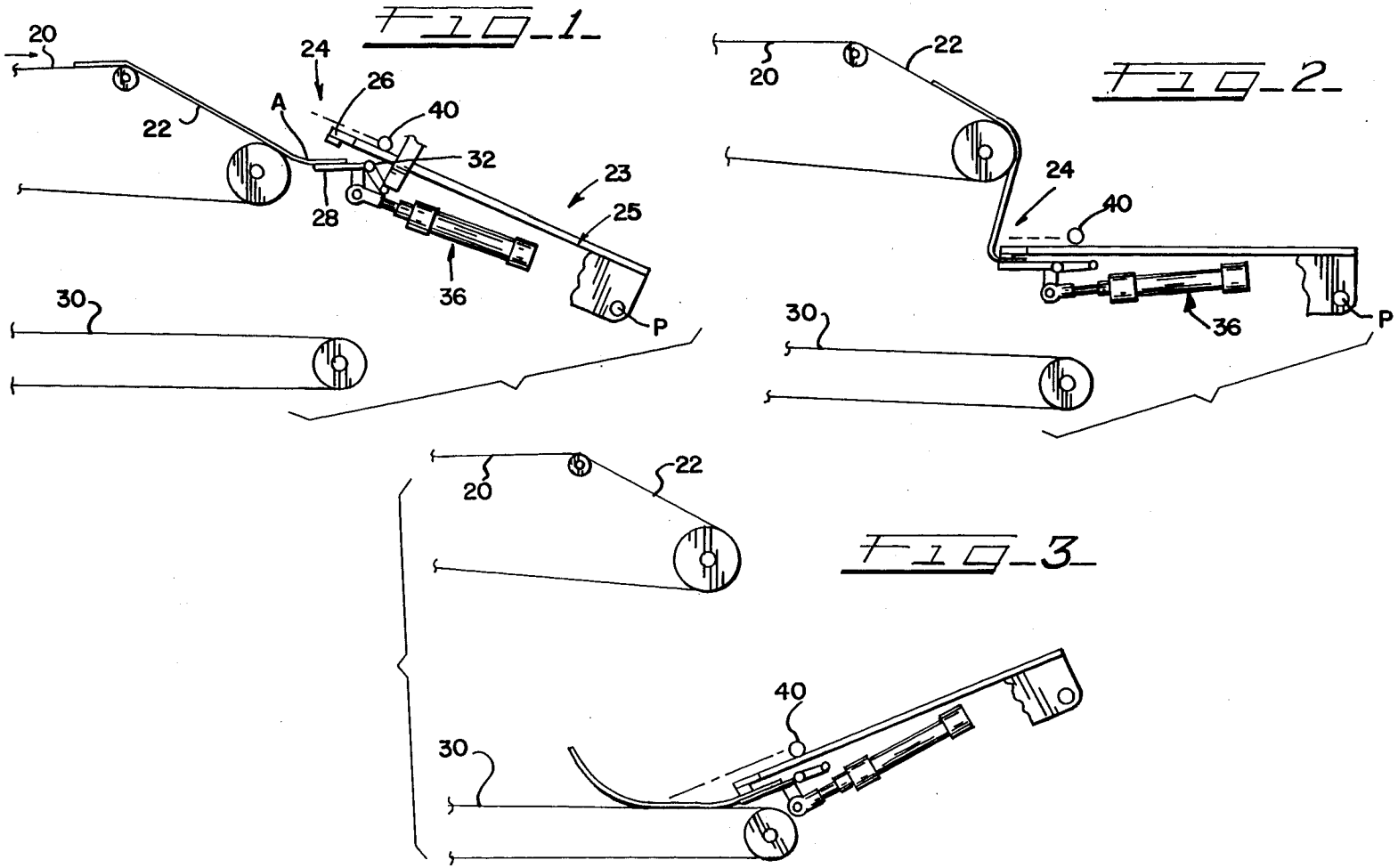
FIGS. 1–6 are schematic side elevational views of a stacking machine embodying the invention, and showing respectively successive stages in the stacking of a laundry article.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1–6, the stacking machine is situated beyond an upper conveyor 20 which has a downwardly-sloping rear portion 22. Articles are fed in the direction of the workflow on conveyor 20, indicated by the arrow, and from portion 22 they are fed to gripping and stacking apparatus generally indicated by reference numeral 23. This apparatus as illustrated, includes carrier means 25 pivoted on a horizontal pivot axis P parallel to the end of the conveyor 20. The carrier means has gripping means 24 including upper and lower jaws 26, 28, shown in an intermediate open position when the carrier means 25 is in a raised article-receiving position, as shown in FIG. 1. The leading edge portion of the article is gripped by closing the jaws as the carrier means 25 is swung down about the pivot axis P to a lower release position where the article is placed on a stack on a lower discharge conveyor 30. This sequence is shown in FIGS. 2 and 3.

The jaws 26, 28 may be horizontally elongated jaw-forming bars where the lower jaw is pivotally supported on a horizontal pivot axis 32 with respect to the upper jaw and is closed by the application of air pressure to a one-way air cylinder assembly 36. Another air cylinder assembly (not shown in FIGS. 1–6) which is arranged to move the carrier means 25 is attached to the carrier means. When the carrier means is raised to its receiving position, the lower jaw 28 is automatically moved to said intermediate open article-receiving position by the action of a mechanical linkage, to be described later, which cooperates with a fixed stop. Thus, the jaws are automatically opened when they reach the receiving position (FIG. 6) and similarly they close to grip the article when air pressure is applied to the cylinder assembly, as will be explained later. As the carrier means is lowered, air streams are generated to push the portion of the article behind the leading edge portion thereof rearwardly in a manner to be explained so the article drops to the rear of the jaws upon a lower conveyor 30.

Figures 4, 5, 6:
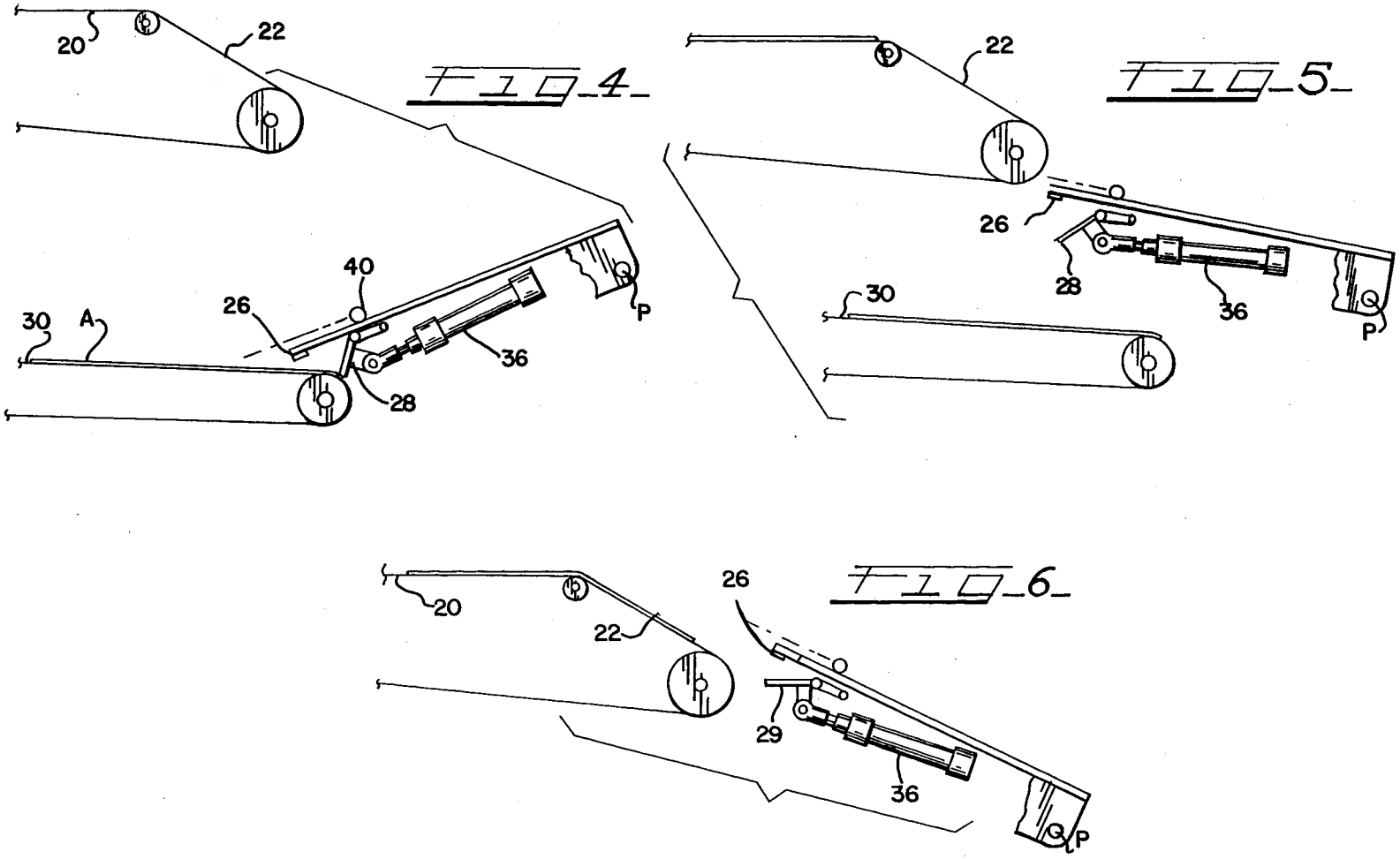

After each article has been placed on the conveyor 30, or on top of the stack of articles thereon, the next operation is to open the jaws fully and then reset the mechanism to start a new operating cycle. Jaw release is effected by removing the air pressure from cylinder assembly 36. The lower jaw 28 then drops to a fully open position to allow the article to be left on the conveyor or stack thereon and the carrier means is returned to its upper article-receiving position. FIG. 4 shows the lower jaw fully opened in the lowermost position of the carrier means, FIG. 5 shows the carrier means being returned to its uppermost position, and FIG. 6 shows the carrier means in the uppermost position where the jaws are open to accept the next article.

Figure 7:
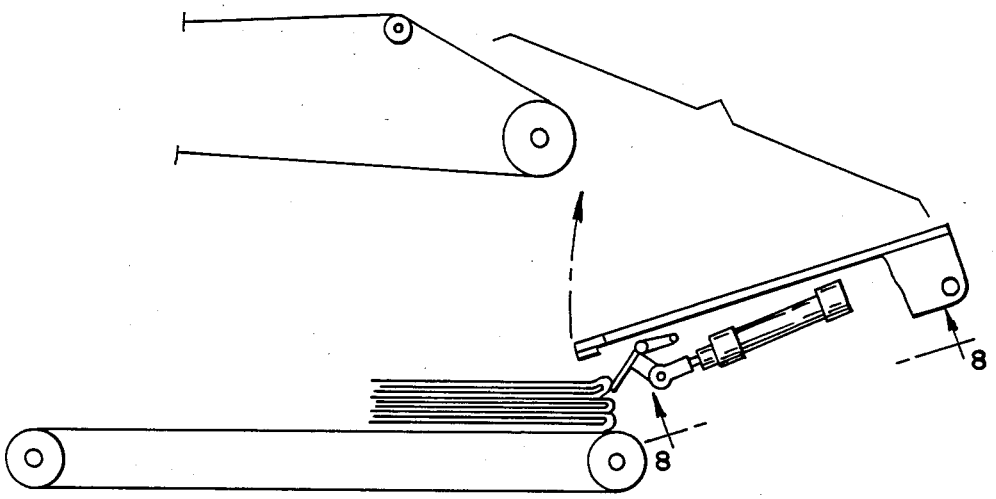
FIG. 7 is a side elevational view showing the form of a lower jaw retraction in the machine.

FIG. 7 shows details of the mechanism whereby the lower jaw is withdrawn so that in being raised to the receiving position it does not lift and disturb the top article on the stack.

In the preferred design, the up and down movement and the lower jaw release movement are made by suitable air cylinders, valves and an appropriate control systems therefor. However, these operations can be made by other mechanical, hydraulic or electrical devices.

As only a predetermined portion of the leading edge of the article is entered into the grip of the jaws, there remains a substantial part of unknown length of the article behind the jaws which must be moved rearward to drop upon the lower conveyor 30. Due to the flexibility of fabric articles, this portion will be in an unstable condition during the downward movement of the carrier means unless a rearward pushing force is then applied thereto. To this end, a stream of air is directed against the article preferably first in a mainly horizontal direction and later at a downwardly inclined direction. Initially at least, this horizontal air stream could be obtained by directing a fixed overhead 45°angle air stream downward upon a deflector plate on the carrier means above the jaws as described in the parent U.S. application Ser. No. 845,123 which directs the air stream horizontally for only a portion of the downward movement of the carrier means. This arrangement places the stationary air stream so far from the article most of the time that very high air pressures are needed. The drawings illustrates an improvement wherein a horizontally elongated air jet tube 40 is mounted on the carrier means so that the tube pivots with the carrier means and always directs air at points always near the article in a changing direction initially horizontal but gradually dropping in angle as the carrier means pivots downwardly.

Figure 8:
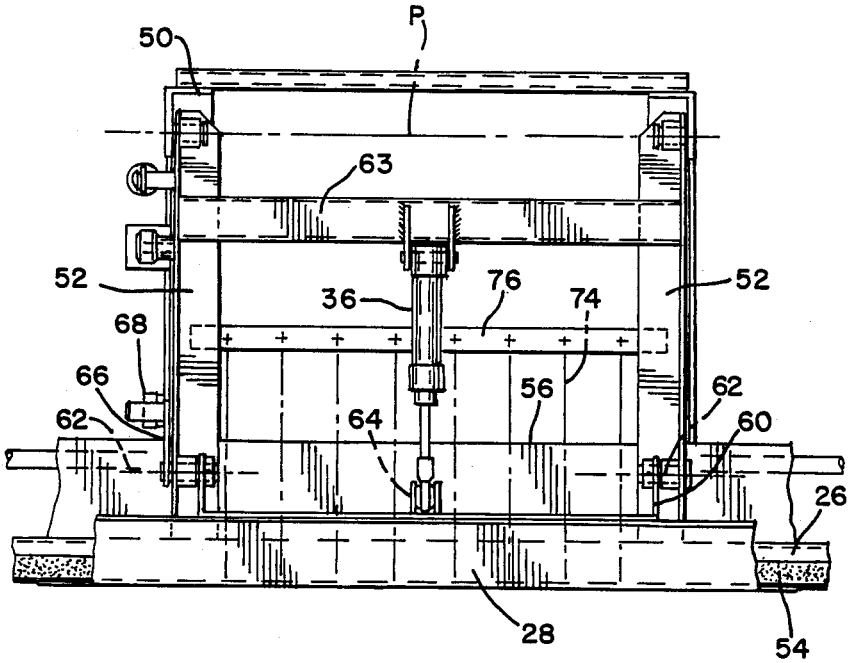
FIG. 8 is a bottom plan view of the stacking machine as viewed along line 8—8 of FIG. 7.
Figure 9:
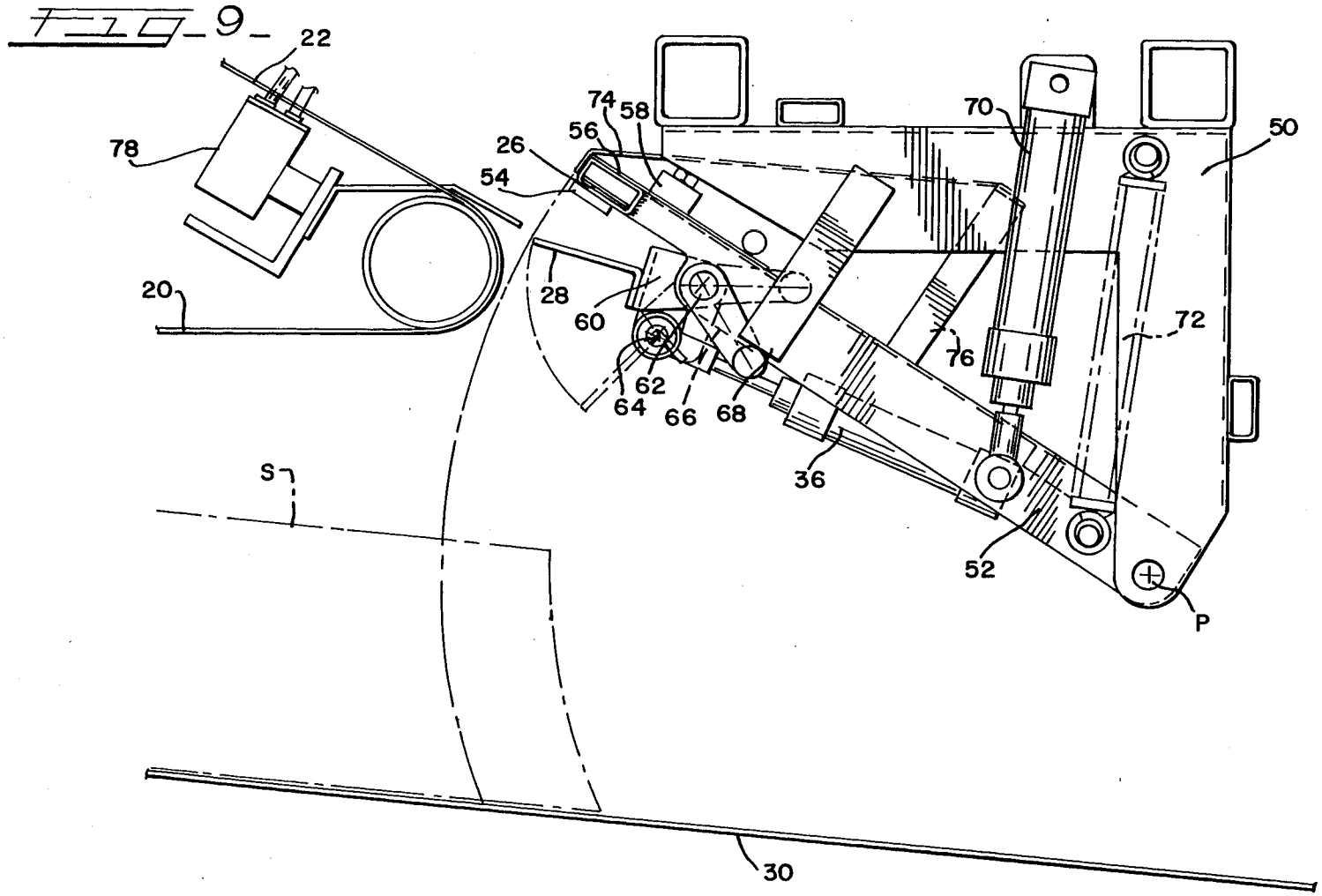
FIG. 9 is a side elevational view showing details of the gripping means of the machine of FIGS. 1–7.

FIGS. 8 and 9 of the drawings show a preferred embodiment of the stacking machine, constructed in accordance with the teachings of the present invention. The carrier means 25 consists of a main carrier frame 50 that has a pair of arms 52 (only one being shown in FIG. 9) pivotally supported on the frame about the pivot point P, the outer end of the arms have an upper jaw or gripping element 26 supported thereon, and the element 26 is preferably covered with a felt strip 54. An upper plate 56 extends between the arms and the upper position for the arms is defined by a rubber stop 58 fixed to the frame 50.

The lower jaw or gripping element 28 is fixedly secured to a linkage 60 that is pivoted about a pivot pin 62 on the arms 52. The fluid cylinder assembly 36 has one end pivotally supported on a cross brace 63 extending between the arms, while the opposite end is pivotally connected to the linkage 60 at 64. The linkage 60 also has a further arm 66 fixed thereto, and the main frame has an abutment or stop 68 aligned with the end of the arm 66. The movement of the jaw assembly or gripping means 24 will be described in detail hereinafter.

The gripping means 24 is pivoted about pin P through a pneumatic cylinder assembly 70 that has one end pivoted on the frame and the opposite end pivoted on the arm adjacent the pivot point P. A counterbalancing means or spring 72 is also interposed between the frame 50 and the arms 52 to counterbalance the over-hung weight of jaw mechanism which thereby allows for lower operating forces for the air cylinder and also increases cycling speeds. The counterbalancing means 72 provides an upwardly-directed force to move the arms or gripping means 24 toward its uppermost position and thus lowers operating forces thereby producing a safety factor in the event that an operator should get a part of the body into the path of movement of the gripping means 24.

The air jet tube 40, discussed above, is carried by the arms and is movable therewith and has openings for directing a stream of air towards the plate 56 so that the air flow will be parallel to the arms and above the jaws 26 and 28.

Also, the mechanism or the gripping means incorporates an apron in the form of a plurality of cords 74 extending between the front end of the arms 52 and a vertical support 76 which will prevent the trailing portion of the article from falling into the air-blown zone and thereby considerably reducing the air pressure requirements. Stated another way, the article support apron will prevent the article from obstructing the flow of the air across the plate 56.

The mechanism so far described operates as follows. The gripping means 24 is initially in the position shown in FIG. 9 and no air is introduced into the cylinder assembly 36 so that the lower jaw or gripping element 28 is held in the position shown in the solid line of the drawing by the arm 66 engaging the stop 68. This position may be referred to as the intermediate article-receiving position for the gripping means 24. As an article A passes a sensing device, such as a photocell 78, the cycling of the stacking device is commenced by circuitry to be described later, and after a predetermined time delay, pressurized fluid is supplied to the one-way cylinder assembly 36 and to the upper end of the cylinder assembly 70. The cylinder assembly 36 thus moves the lower gripping jaw 28 to a clamping position to clamp the article between the jaws 26 and 28, as shown in FIG. 2.

As the downward movement of the gripping means 24 is continued, pressurized air is supplied to the tube 40 to produce air flow over the surface of the plate 56, which in turn directs the tail portion of the article rearwardly or outwardly towards the stack. This movement continues until the end of the gripping means engages the upper article in the stack S, shown in phantom lines in FIG. 9. Because of the relatively low air pressure and forces utilized in the cylinder assembly 70, the movement of the gripping means will be interrupted by the stack of articles so that the lowermost release position is automatically adjusted to the top of the stack of articles. This eliminates the need for any complicated stack-lowering mechanisms, as is required when the gripping means is moved to a lowermost fixed position. The counterbalancing means also assists in reducing the force necessary to raise the carrier frame. When the article reaches the stack S, the flow of the air jet ensures that the article is straight and lays flat on the stack S. As shown in FIG. 3, the air stream shown is directed across the upper surface of the article at a downwardly-inclined component of force.

When the article has been received onto the stack, the pressure of the air on the cylinder assembly 36 is released, thereby allowing the lower gripping jaw to freely pivot counterclockwise as shown about its pivot axis 62 to a fully open position. In so doing, the pivoting action moves the gripping jaws in both a downward direction and a horizontal direction away from the deposited article so that when the carrier frame pivots upwards the lower jaw clears the article without upsetting it. At the same time, the pressurized air is introduced into the lower end of the cylinder assembly 70 to raise the arms 52 towards the uppermost position shown in FIG. 9. As such upward movement commences, the lower jaw 28 will be free to pivot and slide out from between the uppermost article and the adjacent article without disturbing the position of the article, as clearly illustrated in FIG. 7. The lowermost jaw 28 is then freely pivoted to the phantom line position, shown in FIG. 9, which is the fully opened or release position for the lower jaw. As the jaw assembly approaches the uppermost article-receiving position, the free end of the arm 66 will engage the abutment or stop 68 and will cause the lower jaw to be pivoted to the intermediate article-receiving position, shown in the solid line in FIG. 9. Thus, the system is ready for a second cycle of operation.

Several stacking deck arrangements are possible. In one form, the deck can be a simple stop/start conveyor 30 onto which the articles are stacked and when the bundle is complete, the conveyor is momentarily operated to discharge it from the system.

In another preferred form, the deck is a simple hinge platform which can be tilted to a steep angle from where the bundle will slide downward onto a discharge conveyor.

Figure 10:
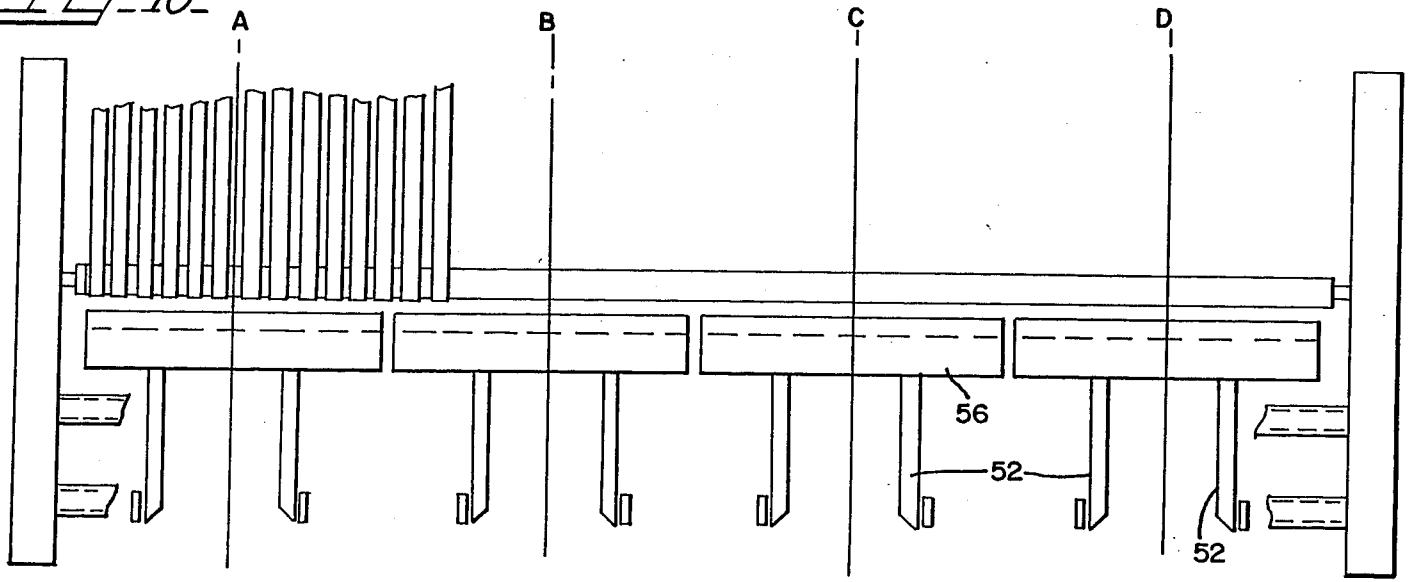
FIG. 10 is a schematic plan view of a multi-lane machine.
Figure 11:
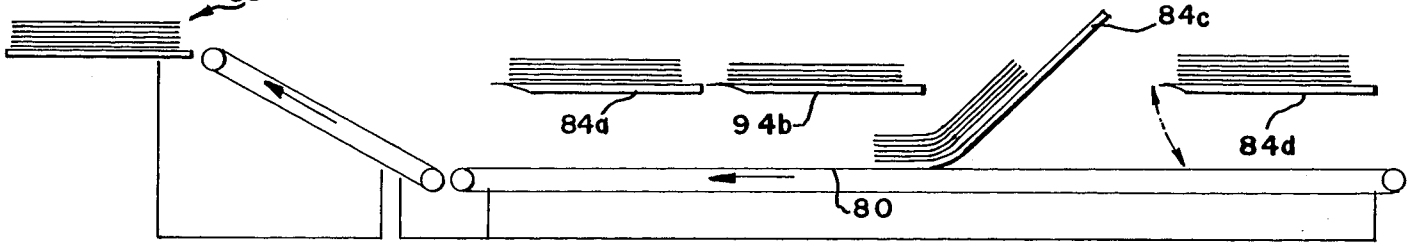
FIG. 11 is a schematic front view of part of a multi-lane machine illustrating the manner of collection of the stacks.
Figure 12:
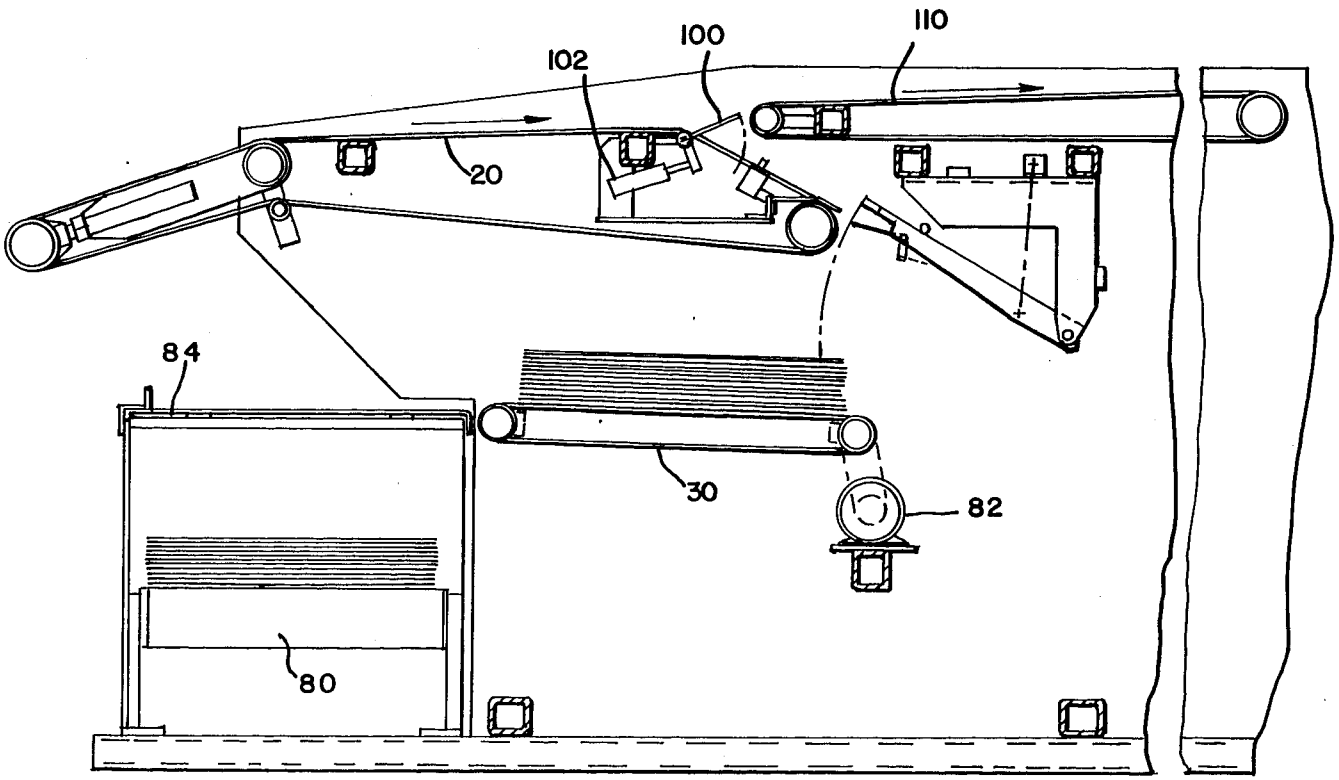
FIG. 12 is a schematic side elevational view of a machine embodying the invention and equipped with a mechanism for discharging stacks of articles in the opposite direction to the direction of the workflow or bypassing the stacking machine; and, FIG. 13 is a schematic diagram of the electrical pneumatic control circuitry for the machine.

Referring to FIGS. 10, 11, 12, there is shown a multi-lane stacking mechanism with a discharge arrangement for discharging the stacks of articles beneath the machine in the opposite direction to the direction of workflow on the conveyor, or alternately bypassing the stacking machine to a second in-line conveyor. The direction of workflow is indicated by the arrow. The elements of the machine described with reference to FIGS. 1–9 are not shown, but an additional discharge conveyor 80 is shown. The discharge conveyor 30 on which the stack of article is received is driven intermittently by a motor 82. When the stack has received a predetermined number of articles, motor 82 is energized and the stack is conveyed to a transfer deck 84. From there, the articles are led away on a discharge conveyor 80.

FIGS. 10 and 11 are schematic views of the discharge arrangement of a four-lane machine, it being understood that there are four stacking and discharge conveyor stations exactly as described arranged closely side by side, as shown in FIGS. 10 and 11 and the upper conveyor 20 is a common belt conveyor encompassing all four stations. A separate sensing photocell 78 is mounted opposite each station. The close arrangement is made possible by the fact that the various pivot-forming bearings for the lower jaw 28 and the carrier arm 52 for each lane can be readily located within the ends of the horizontally elongated jaws 26, 28 which are located contiguous to the jaws of the adjacent lane. The transfer decks for the four mechanisms are shown at **84*a*, 84*b*, 84*c* and 84*d*. Each is tilted when full by a mechanism (not shown) to allow the stack to slide onto the discharge conveyor 80. This conveys the stacks to a common collection point at 86**. The tilting mechanisms are interlocked so that tilting is inhibited if another stack is passing beneath a transfer deck.

The control means may be arranged so that the adjacent pairs of transfer decks **84*a*–84*b* and 84*b*–84*c*** may be operated together. In such case, a manual switch not shown, is moved to a position to connect in parallel the various solenoids of the pair of stations which are to act as one which operate the apparatus in a manner to be described. Also, the switch will then disconnect one of the photocells of each pair of gauged stations so each pair is controlled by one photocell.

The bypass operation is controlled by a series of guide fingers 100 (FIG. 12) which are movably mounted below the conveyor belts of the process conveyor 20 where they can be raised up and down in the gaps between these belts. When the bypass guide fingers 100 are raised by an air cylinder 102, the articles will be directed from the process conveyor 20 onto the conveyor 110. When the fingers are down, the articles will pass under the conveyor 110 to the stacking system.

Figure 13:
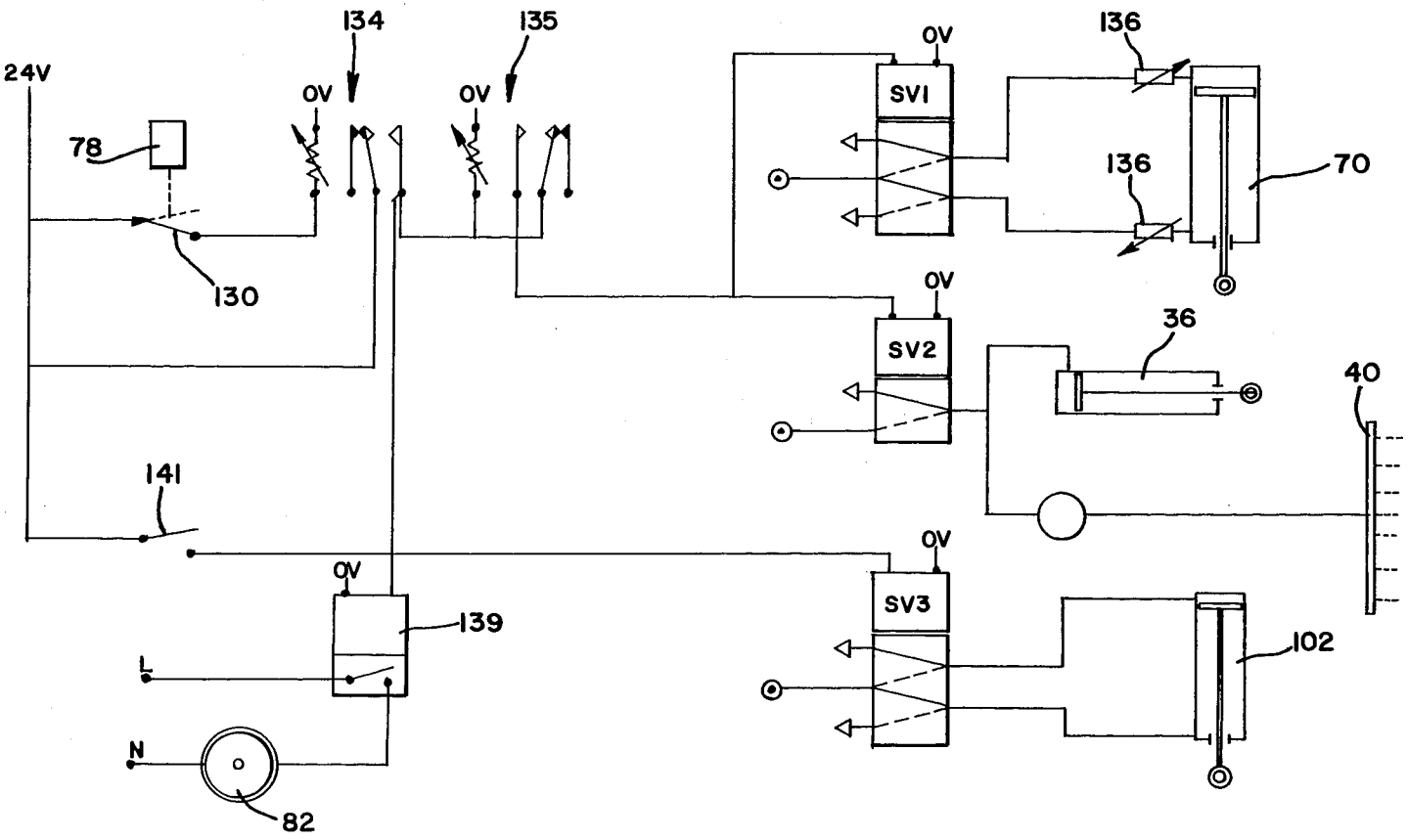

Referring to FIG. 13, a where pneumatic -electric control circuit for each lane is provided using basic electromechanical components. When the leading edge of an article obscures the photosensor 78, a switch 130 in a circuit is opened. This de-energizes the time delay relay 134, which in turn energizes time delay relay 135. Then, after a preset adjustable time, time delay relay 135 operates energizing solenoid valves SV1 and SV2 and consequently air cylinders 36 and 70. The time setting of relay 135 is adjusted to time the leading edge of the article into the jaws of the stacking mechanism, which then close and the arms are pivoted downward to place the article onto the stack. Simultaneously, air is applied to the air jet tube 40 to direct the trailing portion of the article onto the stack. When the trailing edge of the article clears the photosensor 78, the circuit energizes time delay relay 134 and after a preset delay, the relay operates. Relay 134 resets the circuit, the jaws are opened and the mechanism is recycled to the receiving position ready for the next article (FIG. 9).

Two flow control valves 136 are positioned in the lines to cylinder 70 which control and stabilize operating speeds.

When an article is stacked, a count signal is recorded by an electronic countdown device 139. When a preselected number of articles have been stacked, the motor 82, which drives the stacking-receiving conveyor 30, is operated for a timed period of sufficient duration to convey the completed stack from the receiving area.

To bypass the stacker, a switch 141 is operated. This energizes SV3 solenoid valve and air cylinder 102, which raises the bypass fingers or diverting means.

The described circuit is the basic requirement to operate a stacking mechanism. The preferred system will be microprocessor control, programmed to operate the stacker plus any other equipment in the complete process line.

For ease of understanding, the control system has been described in a mechanical/electrical form using relays, microswitches and timers. However, the preferred control system will be fully electronic using a suitable programmed microprocessor system to perform all the necessary functions of counting, sequence and stack discharge and inhibit operations for all lanes.

Of course, various modifications come to mind without departing from the spirit of the invention. For example, the gripping means could be mounted on a suitable vertical linear track rather than the arcuate movement and the jaws could be moved by springs. Also, the cylinder assembly 36 could be a two-way cylinder which would positively move the lower gripping element 28 between gripping and released positions. In this arrangement, the lower jaw 28 would be pivoted to the article-receiving position against the force of the air pressure and would automatically be moved to the gripping position by the air pressure when the arms begin the downward movement.

Also, the air tube could be fixed on the frame to first direct the air along the jaw plate and then at an angle on to the stack.

While specific embodiments have been illustrated and described, numerous modifications come to mind without significantly departing from the spirit of the invention and the scope of protection is only limited by the scope of the accompanying Claims.

I claim:

1. A stacking machine comprising gripping means including a pair of jaws openable and closeable to release and clamp a leading edge of an article therebetween, leaving a free trailing part of the article; carrier means for said jaws movable between an upper article-receiving position where said jaws receive and clamp the leading edge of said article and a lower releasing position where said jaws deposit said leading edge of the article on a stacking plane defined by a support surface which is initially a fixed support surface and after the first article is placed on said surface becomes the upper surface of the last deposited article; carrier driving means for raising and lowering said carrier means and said pair of jaws between said positions; jaw driving means for opening said jaws to receive said leading edge of said article when the carrier means is in said upper position and for then closing the jaws to clamp the article upon downward movement of said carrier means so that the leading edge of each article is pulled down upon said stacking plane, the jaw driving means opening said jaws to release said article when said carrier means is in said lower position; and air flow force-applying means carried by and movable with said carrier means for directing air rearwardly over the free trailing part of said article as the carrier means lower said jaws to the stacking plane, thereby to push the trailing part of the article immediately down upon the stacking plane rearwardly of the point where the leading edge of the article is deposited thereon.

2. The stacking machine as defined in claim 1 in which said jaws include an upper jaw and a lower jaw movable up and down with respect to the upper jaw between a gripping position and a fully open position where the lower jaw is moved horizontally away from the deposited article, so that as the jaws are raised by said carrier means after depositing an article on said stacking plane the jaws will not upset the deposited article.

3. The stacking machine of claim 2 including means on said carrier means for moving said jaws to an intermediate open position when carrier means is moved to said article-receiving position.

4. The stacking machine of claim 1 or 2 wherein there is an upper infeeding conveyor for delivering articles at its discharge end to said jaws when said carrier means is in said upper position.

5. The stacking machine of claim 4 wherein said support surface is the top of a lower discharge conveyor, said lower discharge conveyor being located rearwardly of the discharge end of said upper infeeding conveyor.

6. A stacking machine comprising gripping means including a pair of jaws openable and closeable to release and clamp a leading edge of an article therebetween, leaving a free trailing part of the article; carrier means for said jaws movable between an upper article-receiving position where said jaws receive and clamp the leading edge of said article and a lower releasing position where said jaws deposit said leading edge of the article on a stacking plane defined by a support surface which is initially a fixed support surface and after the first article is placed on said surface becomes the upper surface of the last deposited article; carrier driving means for raising and lowering said carrier means and said pair of jaws between said positions; an upper infeeding conveyor for delivering articles at its discharge end to said jaws when said carrier means is in said upper position; said support surface being the top of a lower discharge conveyor, said lower discharge conveyor being located rearwardly of the discharge end of said upper infeeding conveyor; jaw driving means for opening said jaws to receive said leading edge of said article when the carrier means is in said upper position and for then closing the jaws to clamp the article upon downward movement of said carrier means so that the leading edge of each article is pulled down upon said stacking plane, the jaw driving means opening said jaws to release said article when said carrier means is in said lower position; means for pushing the trailing part of the article immediately down upon the stacking plane rearwardly of the point where the leading edge of the article is deposited thereon; an uppermost bypass conveyor above said upper infeeding conveyor; and means for selectively directing articles to either said uppermost bypass conveyor or to said upper infeeding conveyor.

7. A stacking machine comprising gripping means including a pair of jaws openable and closeable to release and clamp a leading edge of an article therebetween, leaving a free trailing part of the article; carrier means for said jaws movable between an upper article-receiving position where said jaws receive and clamp the leading edge of said article and a lower releasing position where said jaws deposit said leading edge of the article on a stacking plane defined by a support surface which is initially a fixed support surface and after the first article is placed on said surface becomes the upper surface of the last deposited article; carrier driving means for raising and lowering said carrier means and said pair of jaws between said positions, said carrier driving means being a pneumatic cylinder means with air pressure movable means whose movement is stopped by the movement of an opposing force of said support surface or by the stack of articles, so that the stacking plane progressively rises as the number of articles being stacked is increased; jaw driving means for opening said jaws to receive said leading edge of said article when the carrier means is in said upper position and for then closing the jaws to clamp the article upon downward movement of said carrier means so the leading edge of each article is pulled down upon said stacking plane, the jaw driving means opening said jaws to release said article when said carrier means is in said lower position; and means for pushing the trailing part of the article immediately down upon the stacking plane rearwardly of the point where the leading edge of the article is deposited thereon.

8. The stacking machine of claim 1 or 7 wherein said carrier driving means moves said carrier means substantially only in a vertical direction to reduce the floor space area needed to accommodate the stacking machine.

9. The stacking machine of claim 8 wherein said carrier means is mounted for pivotal movement about a horizontal axis.

10. A stacking machine comprising gripping means including an upper jaw and a lower jaw movable up and down with respect to said upper jaw, carrier means for said jaws movable between an upper article-receiving position where said lower jaw initially is in a lowered position to receive the leading edge of said article and is then raised to clamp the leading edge of the article, and a lowered position where said jaws place the leading edge of the article upon a support surface defining a stacking plane, carrier driving means for raising and lowering said carrier means between said positions, jaw driving means for lowering said lower jaws to receive the leading edge of the article when said carrier means is in said upper position and for then raising the same to clamp the article, so that the downward movement of the carrier means pulls the leading edge of the article down upon said stacking plane, said jaw driving means lowering said lower jaw to release said article when said carrier means is in said lower position, and said lower jaw when moved to said fully open position, moving horizontally away from the deposited article, so that as the jaws are raised by said carrier means it will not upset the deposited article.

11. The stacking machine of claim 10 wherein said jaw driving means includes means for moving said jaws to an intermediate position between said fully opened and closed positions when said carrier means is raised to said upper position.

12. In a sheet material stacking machine, carrier means movable between an upper article-receiving position and a lower article-release and discharge position; gripping means on said carrier means movable between a gripping position and a release position, drive means for moving said gripping means between said gripping position and said release position; and abutment means on said frame for engaging and moving said gripping means to an intermediate article-receiving position when said frame is moved to said upper position; counterbalancing means biasing said carrier means to said upper position; and a pneumatic cylinder means for moving said carrier means between said upper article-receiving position and said lower article-release and discharge position where said articles are moved to a stack below said pneumatic cylinder means accommodating variations in stack height so that articles can be stacked on a fixed plane.

13. A stacking machine as defined in claim 12, in which said gripping means grips a leading edge of said articles leaving a free trailing part of said article, further including force-applying means for applying a rearward force to said trailing part of the article to stabilize and straighten said trailing part on said stack.

14. A stacking machine as defined in claim 13, in which said force-applying means is carried by said carrier means.

15. A stacking machine as defined in claim 1 or 14, further including an apron carried by said arm and extending over said air flow free-applying means to prevent articles from falling upon said force-applying means.

16. A fabric stacking machine including gripping means, carrier means upon which said gripping means is carried and pivoted about a fixed horizontal axis, counterbalancing means for urging said gripping means toward an upper article-receiving position, and pneumatic drive means for moving said carrier means from said upper article-receiving position downward to a lower article-discharge position on a stack of said articles, so that movement of said carrier means is interrupted by engagement of said gripping means with said stack and the article-discharge position is dependent upon the height of the stack.

17. A fabric stacking machine as defined in claim 16, further including discharge conveyor means for moving said articles along a path, said carrier means pivoted about a horizontal axis above said conveyor means and on which said stack of articles is located below said path.

18. A fabric stacking machine as defined in claim 17, further including bypass conveyor means above said discharge conveyor means, conveyor means for delivering articles to said gripping means, and directing means actuatable to bypass said gripping means and direct said articles to said bypass conveyor means.

19. A fabric stacking machine as defined in claim 17, in which said articles are gripped along leading edges, leaving free the trailing part of the article, and further including air flow means directed across said article while said article is being moved to said article discharge position to straighten said trailing part.

20. A stacking machine as defined in claims 1–4, 12 or 16 wherein there are at least one pair of said carrier means and gripping means mounted side-by-side in front of a common infeeding conveyor means to form a multi-lane stacking system, said carrier and gripping means being operable either together to stack a relatively wide article or operable separately to stack narrower articles delivered thereto at random times.

* * * * *